United States Patent [19]

Potts

[11] Patent Number: 4,781,331

[45] Date of Patent: Nov. 1, 1988

[54] MINERAL BREAKER

[76] Inventor: Alan Potts, Geneina, No. 1 Chapel Lane, Ravenshead, United Kingdom

[21] Appl. No.: 107,911

[22] Filed: Oct. 15, 1987

Related U.S. Application Data

[63] Continuation of Ser. No. 823,673, Jan. 29, 1986, abandoned.

[30] Foreign Application Priority Data

Feb. 6, 1985 [GB] United Kingdom ..... 8502961
Aug. 2, 1985 [GB] United Kingdom ..... 8519516

[51] Int. Cl.[4] ..... B02C 18/18

[52] U.S. Cl. ..... 241/236; 241/294; 241/300; 299/91

[58] Field of Search ..... 241/189 R, 190, 191, 241/195, 197, 236, 293, 294, 295, 300, 277, 282.2; 299/79, 88, 89, 90, 93, 91

[56] References Cited

U.S. PATENT DOCUMENTS 4,202,504 5/1980 Cameron ..... 241/197 X
4,374,573 2/1983 Rouse et al. ..... 241/197 X

*Primary Examiner*—Howard N. Goldberg
*Assistant Examiner*—Joseph M. Gorski
*Attorney, Agent, or Firm*—Ratner & Prestia

[57] ABSTRACT

A mineral breaker including at least one breaker drum carrying a plurality of breaker teeth projecting radially therefrom, at least one breaker tooth comprising a tooth core projecting radially outwardly of the drum and having leading and trailing faces, an open sided tooth sheath including a leading wall and a trailing wall connected to one another at one end by a connecting wall which forms the terminal end of the tooth, the inner surfaces of the leading and trailing walls of the tooth sheath having flat faces which abuts against opposed flat faces on the tooth core.

9 Claims, 3 Drawing Sheets

MINERAL BREAKER

This application is a continuation of application Ser. No. 823,673, filed 1-29-86, now abandoned.

The present invention relates to a mineral breaker.

In a mineral breaker of the type disclosed in our European Patent Application No. 83900287.0 (Publication No. 0096706) a breaker drum is provided having a series of radially projecting teeth spaced both circumferentially and axially along the drum.

The corresponding U.S. application is copending application Ser. No. 008,053, filed Jan. 16, 1987 which is a continuation of application Ser. No. 824,301, filed Jan. 30, 1986 now abandoned, which is a continuation of application Ser. No. 532,021, filed Aug. 19, 1983 now abandoned.

The mineral sizer to which the aforementiond published European Patent Application and copending U.S. application are directed includes a housing having sides and end walls. The housing is conveniently fabricated from steel plate panels which are bolted and welded together.

Rotatably mounted to extend between the end walls are a pair of breaker drum assemblies each of which is geared at one end of the other so that they are driven from a common drive to be rotated in opposite directions. The drums are rotated so as to direct material between them. The gear connection between the drums also serves to set the rotary positions of the drums relative to one another.

Each drum assembly is provided with circumferentially extending groups of breaker teeth, the groups being spaced axially along the drum assembly. The axial spacing of the groups on one drum assembly is staggered to that on the other drum assembly so the teeth in one group on one drum assembly pass between an adjacent pair of groups on the other drum assembly.

The teeth are also preferably arranged to define a series of discrete helical formations which are spaced circumferentially about each drum assembly. The helical formations extend along the axes of each drum in a different sense, i.e. for one drum the helical formations extend away from the nearest end wall in an anti-clockwise sense and for the other drum the helical formations extend in a clockwise sense. Preferably each helical formation in extending along its respesctive drum passes through an arc of about 90°.

The shape of the teeth and their relative positions and size are such that during use, two types of breaking action are present, viz a primary breaking action on larger pieces of mineral whereat the mineral is gripped between opposing leading faces of the teeth on opposite drums and a secondary breaking action wherein mineral is trapped between the rear edges of the teeth and the leading face of another tooth. Preferably the arc through which end helical formation passes is such as to ensure that a secondary breaking action occurs.

Additionally the spacing between the drums is chosen so that when the tips of the teeth on one drum sweep past the trough defined between groups of teeth on the other drum there is sufficient clearance so that compaction of material is avoided. Accordingly by a suitable choice of spacing it is possible for fine material to quickly pass through the sizer without compaction, thus leaving the sizer to break down larger pieces of material either by the primary and/or secondary breaking action.

The shape of the teeth is designed bearing in mind the hardness and tensile strength of the mineral to be broken. Preferably the teeth are designed to provide as much bit as possible for the primary type of breaking action for the diameter of the drum assembly so as to positively grip large pieces of material. Accordingly the ratio of height of teeth relative to drum diameter is normally large. For example, the tooth height to diameter of drum ratio can be 1: 4. In this respect, in the crosssectional extent of a bite region for primary breaking, the depth of the bite region is defined by the trailing edge of one tooth and the leading edge of a succeeding tooth; and the length of the bite region is defined between the leading face of one tooth and the leading face of an opposed tooth on the opposite drum. The trailing edge which is slightly curved, but which may be straight if desired, is chosen to be approximately tangential to the drum diameter and the leading face is chosen to be approximately located radially relative to the drum. The grip region between teeth on the same group may be varied to alter the size of the grip region by either altering the size of the tooth or by altering the number of teeth in each group, the maximum grip region being achieved when the point of intersection of a leading face is on or behind (in the direction of rotation of the drum) the location whereat the trailing edge of the preceding tooth merges into the periphery of the drum.

When the teeth are arranged to form helical formations the grip region varies in width longitudinally of the drums. Accordingly a large piece of material undergoes a succession of primary breaking actions and due to the helical formation the large piece of material is exposed to twisting forces and is urged to move axially along the drums. These actions on a large piece of material result in the piece being successively exposed to positive primary breaking actions and cause it to dance on the drums and do not allow it to settle on them. A similar action is imposed during secondary breaking. Thus problems associated with pieces of mineral settling on the drums and becoming grooved by the rotating teeth are avoided.

A further advantage resulting from the actions imposed on a large piece of material by the helical formations is that the large piece is positively moved along the axes of the drums thereby permitting smaller pieces to pass downwardly thereby and pass through the mineral breaker. Accordingly the mineral breaker is able to handle an in-fill of mineral which contains a large variation in size such as mineral obtained in open-cast quarrying which contains small particulate material as well as large lumps of material.

It will be appreciated that the teeth impose tensile breaking forces onto the mineral and so positively breaks the material with minimal production of fines. Additionally since each tooth passes between groups of teeth on the opposite drum positive sizing of mineral occurs since the maximum size of mineral passing through the sizer is determined by the space between the trailing edge of one tooth and the leading face of a succeeding tooth and the distance between adjacent groups of teeth. Therefore if the in-fill material contains only large pieces of mineral the mineral on leaving the sizer will contain no pieces over a predetermined size and will contain a small quantity of fines.

It is also envisaged that the breaker drums may be inclined to the horizontal and arranged so that large peices of mineral are made to climb up the incline by the helical formations. Due to the agitation of the large piece of mineral it is likely to fall down the incline and is accordingly repeatedly moved along the drums until it has been broken down sufficiently to be broken by the secondary breaking action.

The mineral sizer is normally located above a takeaway conveyor so that the axes of the drums are generally parallel to the direction of travel of the conveyor. By setting the sizer so that the spacing between the drums is generally located above the longitudinal axis of the conveyor material being deposited by the sizer onto the conveyor is arranged centrally thereon. This is advantageous as it minimizes spillage.

It is highly desirable to construct the teeth so as to have a core of impact resistant material and a tooth sheath enveloping the core, the sheath being made of a wear resistant material such as a high manganese content steel.

Under working conditions loadings placed on the tooth sheath are transmitted to the core to be absorbed. Ideally the fit between the sheath and core should be an accurate one so that relative movement therebetween is not experienced during impacts on the teeth when hitting the mineral to be broken. If movement is allowed 'chattering' of the sheaths on their respective cores occurs which progressively becomes worse as wear takes place between the core and covering sheath.

The tendencey of chattering to occur increases with an increase in the height of tooth and so the larger the design of tooth the greater the need to ensure a close fit between the tooth sheath and its supporting core.

It is a general aim of the present invention to provide a tooth construction for a mineral breaker of the type disclosed in European Patent Publication No. 0096706 wherein the tooth construction includes a core having a sheath mounted thereon which is a close and accurate fit.

According to one aspect of the present invention there is provided a mineral breaker including at least one breaker drum carrying a plurality of breaker teeth projecting radially therefrom, at least one breaker tooth comprising a tooth core projecting radially outwardly of the drum and having leading and trailing flat faces, an open sided tooth sheath including a leading wall and a trailing wall connected to one another at one end by a connecting wall which forms the terminal end of the tooth, the inner surfaces of the leading and trailing walls of the tooth sheath having flat faces which abut against opposed flat faces on the tooth core.

Accordingly, since the tooth sheath is open sided it is possible to gain access to the inside faces of the sheath to machine them as desired to cater for tolerances and flaws occuring during casting of the tooth sheaths. In addition, since the leading and trailing walls of the tooth sheath are connected at one end by the connecting wall, it is possible for the leading and trailing walls to flex slightly. This is advantageous since when through bolts are used passing through the leading and trailing walls, the walls can be deflected inwardly by tightening of the bolts to bring the mating flat faces of the tooth core and sheath into close contact should there be slight clearance therebetween prior to insertion of the bolts.

Various aspects of the present invention are hereinafter described with reference to the accompanying drawings, in which:

FIG. 4 is a part perspective view of a mineral sizer incorporating the present invention.

Figure 1:
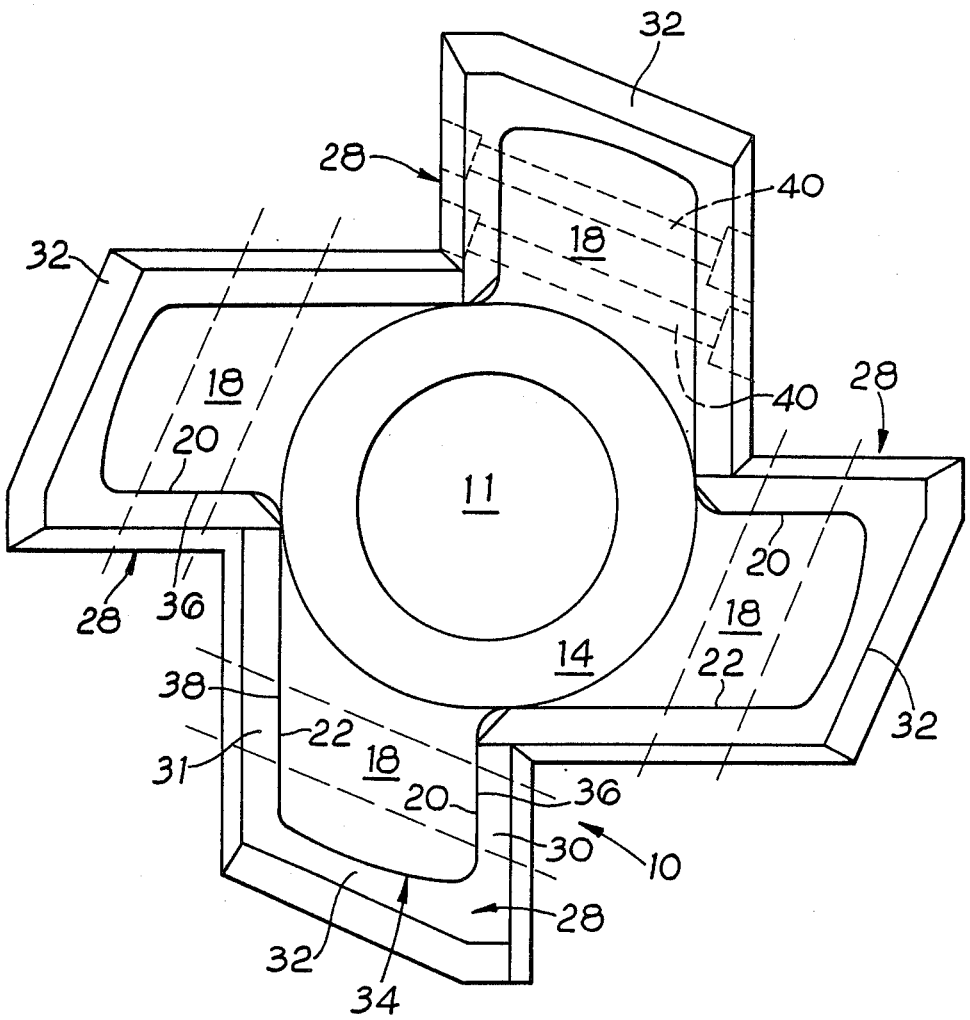
FIG. 1 is a side view of a multi-toothed ring assembly for use in constructing a mineral breaker drum.

In the drawings there is shown a ring assembly 10 having an internally splined bore 11 for receiving a splined drive shaft (not shown). In use, a plurality of ring assemblies 10 are mounted side by side on a common shaft to define a breaker drum for a mineral breaker. See for instance our European Patent Application No. 83900287.0 (Publication No. 0096706).

The ring assembly 10 includes an annular portion 14 from which projects four tooth cores 18. The annular portion 14 and tooth cores 18 are preferably formed in one piece by casting a suitable steel. Each tooth core 18 is formed so as to have a planar leading or front face 20 and a planar trailing or rear face 22. These faces are preferably finished by grinding to achieve accurate predetermined dimensions therebetween. Preferably the faces 20, 22 are parallel.

Each tooth core 18 is provided with a tooth sheath 28 to form a tooth construction for breaking mineral. Each tooth sheath 28 is preferably formed of a hard wearing abrasive resistant material such as a high manganese content steel. Each tooth sheath 28 is formed by casting and comprises a leading wall portion 30, a trailing wall portion 31 and an upper connecting wall portion 32 which extends between the leading and trailing wall portions and in use defines the tip or terminal end of the tooth. The sheath 28 is open sided to define openings 34 on both sides (only one opening being visible). The opposed inner faces 36, 38 of the leading and trailing wall portions are planar and in use abut against the planar faces 20, 22 of the tooth core. The openings 34 provide access to the opposed inner faces 36, 38 of the leading and trailing wall portions respectively to enable finishing operations, such as grinding, to be performed on these faces to thereby enable an accurate fit to be achieved.

Bolt bores 40 are provided which extend through the leading and trailing wall portions of the sheath and associated core. Bolts (not shown) pass through the bores 40 and serve to hold the sheath on its associated core. Since the leading and trailing wall portions are connected to one another at one end only, they are able to flex by an amount determined by the material from which they are made and the dimensions of the wall portions. Accordingly on tightening of the bolts, the wall portions are urged inwardly and it is thereby ensured that the inner faces 36, 38 are effectively clamped into engagement with mating faces 20, 22 respectively formed on the core.

The width of the leading wall portion, upper wall portion and trailing wall portion are preferably chosen so as to cover the leading face, terminal end face and trailing face of its associated tooth core.

Figure 2:
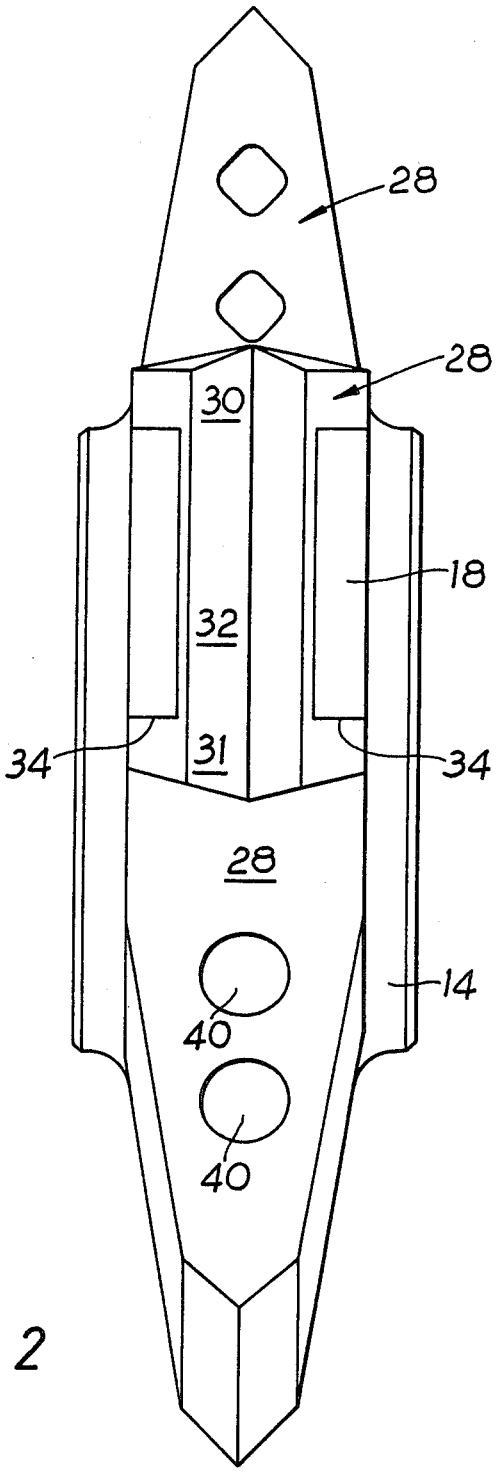
FIG. 2 is an end view of the assembly shown in FIG. 1.

As seen more clearly in FIG. 2, the exposed faces of the tooth sheath may be shaped to provide an optimum working profile, in the illustrated embodiment these faces are shaped to define a central raised portion.

In the embodiment of FIGS. 1 and 2, the bolts also serve to restrain lateral and radial movement of the sheath relative to the core.

Figure 3:
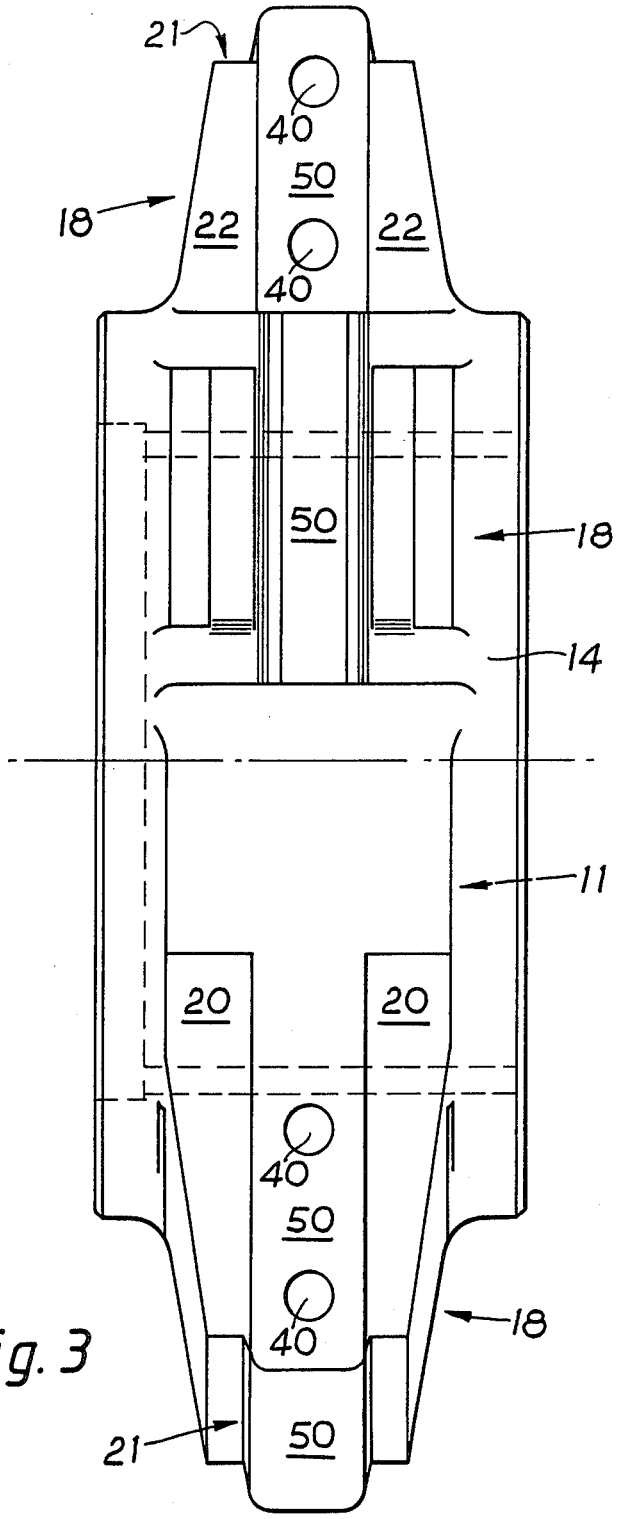
FIG. 3 is an end view of a modified ring assembly.

In the embodiment of FIG. 3 a tongue 50 is provided which is located centrally of the core and which extends along its leading face 20 along its terminal end face 21 and along its trailing face 22.

The tooth sheath 28 is provided with a complementary groove for receiving the tongue and the tongue and groove co-operate to restrain lateral movement of the tooth sheath relative to the core. The depth of the groove is preferably the same as or slightly greater than the height of the tongue so that opposed planar faces of the core and leading and trailing wall portions located on both sides of the tongue and groove arrangement are brought into mutual abutment after tightening of the bolts.

If desired, the tongue 50 may extend along either the leading face or the trailing face of the terminal end face only or along any combination of these faces.

FIG. 4 corresponds to FIG. 1 of the published European Patent Application referred to in the introduction. The mineral sizer shown in FIG. 4 has a pair of breaker drum assemblies 60 and 62 each including multi-toothed ring assemblies constructed in accordance with the present invention.

I claim:

1. In a mineral breaker having at least one breaker drum including a plurality of breaker teeth projecting radially from the drum and further including a plurality of opposed breaker teeth positioned so that, on rotation of the drum, mineral lumps to be broken are gripped between the leading faces of the teeth on the drum and said opposed teeth to thereby break the mineral lumps gripped therebetween by a snapping action, the improvement of each breaker tooth on said drum comprising a tooth core projecting radially outwardly of the drum and having flat leading and trailing faces, (b) an open sided tooth sheath seated on the core to cover said leading and trailing faces of that core, the tooth sheath comprising a leading wall and a trailing wall connected to one another only at one end by a connecting wall which forms a terminal end of the tooth, the inner surfaces of the leading and trailing walls of the tooth sheath having flat faces which abut against the flat leading and trailing faces of the tooth core, respectively, and (c) fastening means for deflecting the leading and trailing walls of the tooth sheath inwardly to clamp the flat faces of the tooth sheath into abutment with the flat leading and trailing faces of the tooth core.

2. A mineral breaker according to claim 1 wherein the tooth core and tooth sheath are provided with co-operating formations for restraining relative movement between the tooth core and the tooth sheath in an axial direction of the drum.

3. A mineral breaker according to claim 2 wherein the co-operating formations include a tongue formation on the core.

4. A mineral breaker according to claim 3 wherein the tongue extends along at least one of the leading, trailing or terminal end faces of the core.

5. A mineral breaker according to claim 1 wherein the fastening means comprises at least one bolt which passes through the leading and trailing walls of the tooth sheath and into the tooth core.

6. A mineral breaker according to claim 1 wherein each bolt extends through the leading wall of the tooth sheath through the tooth core and through the trailing wall.

7. A mineral breaker according to claim 1 wherein the breaker drum includes a plurality of ring assemblies mounted side by side on a shaft, each ring assembly having an annular portion and projecting therefrom a plurality of said cores spaced about its circumference.

8. A mineral breaker according to claim 1 wherein the annular portion and cores are formed as one piece.

9. A mineral breaker according to claim 8 wherein the sheath is cast from a high manganese content steel.

* * * * *

UNITED STATES PATENT AND TRADEMARK OFFICE

CERTIFICATE OF CORRECTION

PATENT NO. : 4,781,331

DATED : November 1, 1988

INVENTOR(S) : ALAN POTTS

It is certified that error appears in the above—identified patent and that said Letters Patent is hereby corrected as shown below:

Column 5, line 32 (Claim 1, line 10) before "a" insert --(a)--.

Column 6, line 24 (Claim 6, line 1) cancel "1" and insert --5--.

Column 6, line 33 (Claim 8, line 1) cancel "1" and insert --7--.

Column 6, line 35 (Claim 9, line 1) cancel "8" and insert --1--.

Signed and Sealed this

Fourth Day of April, 1989

*Attest:*

DONALD J. QUIGG

*Attesting Officer*

*Commissioner of Patents and Trademarks*